US011503879B2

(12) United States Patent
Maia

(10) Patent No.: US 11,503,879 B2
(45) Date of Patent: Nov. 22, 2022

(54) OUTER SOLE WITH REMOVABLE SLIDING SYSTEM

(71) Applicant: PLANITOI S.A., Santa Maria de Feira (PT)

(72) Inventor: Paulo Maia, Santa Maria de Feira (PY)

(73) Assignee: PLANITOI S.A., Santa Maria Da Feira (PT)

( * ) Notice: Subject to any disclaimer, the term of this patent is extended or adjusted under 35 U.S.C. 154(b) by 0 days.

(21) Appl. No.: 16/756,517

(22) PCT Filed: May 30, 2019

(86) PCT No.: PCT/IB2019/054483

§ 371 (c)(1),
(2) Date: Apr. 16, 2020

(87) PCT Pub. No.: WO2020/109874

PCT Pub. Date: Jun. 4, 2020

(65) Prior Publication Data

US 2021/0267314 A1 Sep. 2, 2021

(30) Foreign Application Priority Data

Nov. 27, 2018 (PT) ..... 115177

(51) Int. Cl.
*A43C 19/00* (2006.01)
*A43B 13/12* (2006.01)
(Continued)

(52) U.S. Cl.
CPC ..... *A43C 19/00* (2013.01); *A43B 13/122* (2013.01); *A63C 17/008* (2013.01); *A63C 17/08* (2013.01);
(Continued)

(58) Field of Classification Search
CPC ..... A43C 19/00; A43B 13/122; A43B 5/16; A63C 17/008; A63C 17/08; A63C 17/22;
(Continued)

(56) References Cited

U.S. PATENT DOCUMENTS 6,406,038 B2 * 6/2002 Adams ..... A63C 17/08 301/5.301
11,083,244 B2 * 8/2021 Boys ..... A43B 13/187
(Continued)

FOREIGN PATENT DOCUMENTS

CN 113966893 A * 1/2022 ..... A43B 13/122
EP 1175160 B1 * 10/2003 ..... A43B 5/1633
(Continued)

*Primary Examiner* — James A Shriver, II
*Assistant Examiner* — Michael T. Walsh
(74) *Attorney, Agent, or Firm* — Mark M. Friedman

(57) ABSTRACT

The present invention concerns the field of garments, namely the shoes sector, especially relating to children, although it is likewise applicable to young people and adults. The object of the present invention is an outer sole (1), on which are inserted two structures, a first one enabling one user to slide when he is contacting the ground, moving as if he were on skates, and a second one enabling the user to move in a conventional way. The first structure, which enables a movement in a rolling mode, consists in a frame (2) containing a wheel (3) and, on one end, presents a front locking member (4) and, on another end, a locking member (5) for disengagement of the frame (2) by pressing downwards.

8 Claims, 4 Drawing Sheets

(51) Int. Cl.

| | |
|---|---|
| ***A63C 17/08*** | (2006.01) |
| ***A63C 17/22*** | (2006.01) |
| ***A63C 17/00*** | (2006.01) |
| *A63C 17/20* | (2006.01) |

(52) U.S. Cl.
CPC ..... *A63C 17/22* (2013.01); *A63C 17/20* (2013.01); *A63C 2203/10* (2013.01)

(58) Field of Classification Search
CPC . A63C 17/20; A63C 2203/10; A63C 2203/06; A63C 17/0013; A63C 17/002
See application file for complete search history.

(56) References Cited

U.S. PATENT DOCUMENTS

| | | | | |
|---|---|---|---|---|
| 11,331,561 | B1 * | 5/2022 | Wu | A63C 17/008 |
| 2004/0227310 | A1 * | 11/2004 | Jeon | A63C 17/1409 280/11.217 |
| 2007/0252351 | A1 * | 11/2007 | McNamara | A63C 17/20 280/11.24 |
| 2013/0036630 | A1 * | 2/2013 | Gavrieli | A43B 3/248 36/102 |
| 2021/0045489 | A1 * | 2/2021 | Watson | A43B 13/14 |

FOREIGN PATENT DOCUMENTS

| | | | | |
|---|---|---|---|---|
| EP | 1481714 | A1 * | 12/2004 | A63C 17/008 |
| GB | 2380685 | A * | 4/2003 | A43B 5/1633 |
| KR | 20080050559 | A * | 6/2008 | |
| KR | 20120000910 | A * | 1/2012 | |
| KR | 20120000910 | A * | 4/2012 | |

* cited by examiner

OUTER SOLE WITH REMOVABLE SLIDING SYSTEM

FIELD AND BACKGROUND OF THE INVENTION

The present invention concerns the field of garments, namely the shoes industry, especially in respect of children, although it is also possible to use it on shoes intended for young people and adults.

The object of the present invention is an outer sole (1), on which is inserted a rolling mechanism (18) in the region supporting the heel, or front region, which, when in contact with the ground allows the user to slide, moving around as if he were using skates. In addition, the rolling mechanism (18) inserted in the outer sole (1) is removable, i.e. when the user so wishes, he may remove it by pressing on the rear portion, going from a rolling mode to a conventional walking way and he may place a frame (13) therein.

The system, object of the present invention, may be presented in multiple solutions, from shoes, sports shoes or mountaineering shoes, boots, slippers, any kind of shoes on which it may be possible to include a solution composed by one outer sole (1) on which may be inserted at least one frame (2) (13) to operate as a rolling mechanism (18) or as a lid. It should be noted that the frames (2)(13) are housed in one opening (9) that the sole (1) must exhibit, and they are both attached to the outer sole (1) by means of an engagement portion (12) existing in a ramp (10) presented by the outer sole (1) in its rear end and which is also presented by the frames (2) (13) that are detailed hereafter. By rear end it should be understood the heel area, opposed to the front end or toes area.

The solutions existing in the market offer the use of shoes with wheels or roller bearings which integration in the outer sole is not easy, i.e., the user needs a tool to extract the wheel when he just wants to use his shoe in a normal way.

Although this system is applicable to all kinds of shoes and for all ages, this model is, preferably, typically directed to a childish/youngster public.

The present invention finds close priors in European Patent EP1175160 which discloses one piece of shoe with an outer sole comprising a heel area that presents a cavity where are inserted retractile rolling means rotatably mounted on one shaft, attached to an integrated structure in the outer sole. European Patent EP1175160 further discloses that the rolling means can be wheels and they are removable together with their shaft by means of tools like a screwdriver, an adjustable wrench and the like. Thus, the above mentioned closest state of the art differs, for instance and outstandingly, from the present invention because it does not show any element by which it may be possible to remove the rolling system manually, limiting the option of disengaging the roller to the use of tools.

The present solution for a shoe with a rolling mechanism that is removable by manual pressure, solves this problem because, when the frame (2) is put in place, the shoe is immediately ready to roll, i.e., the user is prepared to slide on the ground. When such use is finished, simply and swiftly, the user himself may withdraw the frame (2) by manually pressing downwards the rear portion of the shoe.

After the removal of the frame (2), the user inserts the frame (13), which acts as a lid.

The present invention brings to the state of the art the following practical advantages:

- Elimination of the use of tools to remove and put in place the mechanisms that enable the shoe to roll;

- The disengagement of the frame (2) is done manually in a clean region, not by the wheels which are in contact with the ground;
- An easy and fully functioning system to engage/disengage the frames (2)(13);
- Easy to substitute and maintain;
- Enables a practical and periodical cleaning of the frames (2)(13) engaging area;
- Shoe fit for daily use, suitable for children since the rolling mechanism (18) is promptly removed, if necessary;
- A versatile shoe since it may be used either in a rolling mode or in a conventional way;
- Pedagogic, since the system may be removed by the child/youngster himself.

SUMMARY OF THE INVENTION

The object of the present invention is an outer sole (1) on which is inserted a rolling mechanism (18), consisting in a frame (2) and at least one wheel (3), which, while contacting the ground enables the user to slide, or, alternatively, a frame (13) that enables the user to move without sliding, i.e., conventionally walking.

Both the frames (2) (13) that are inserted in the outer sole (1), are removable, i.e., when the user so wishes, he may remove the frame (2) and/or the frame (13), by pressing downwards the locking members (5) or (15), existing in the frames (2)(13), as shall be detailed hereafter. The possibility of removing the frames (2) (13) is made possible by using pressure, e.g., by placing one finger on the locking members (5) or (15), thus easily enabling the user to alternate between the two possible modes of moving, by disengaging and engaging the frames (2)(13).

It should be noted that the frames (2)(13) are inserted in an opening (9) provided in the outer sole (1) and they are both attached to the outer sole (1) by means of an engagement portion (12) arranged on the surface opposing the ramp (10) and some elements provided in the frames (2) (13).

DETAILED DESCRIPTION OF THE INVENTION

Figure 1:
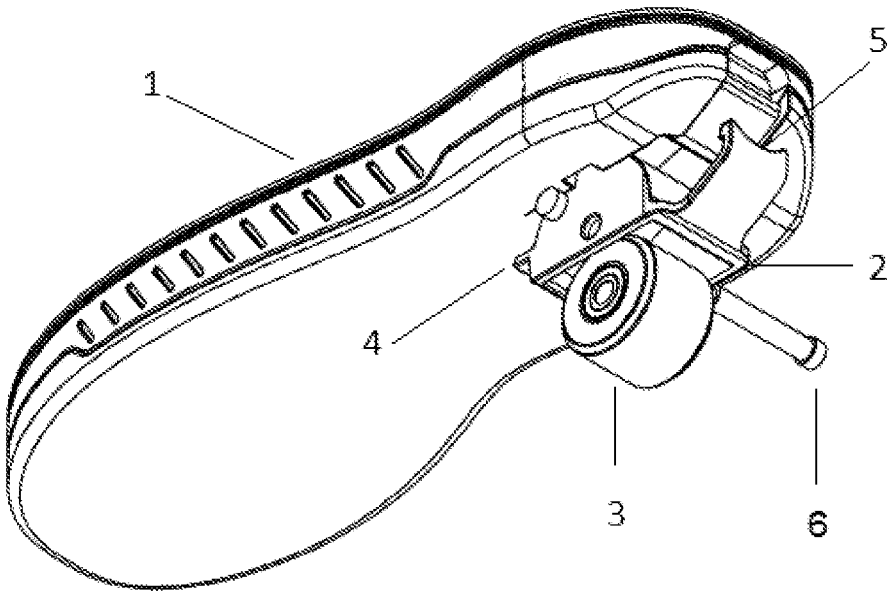
FIG. 1—is a perspective view of the outer sole (1), on which a frame is inserted (2) containing a wheel (3), a front locking member (4) on one end and a locking member (5) on the other end.
Figure 2:
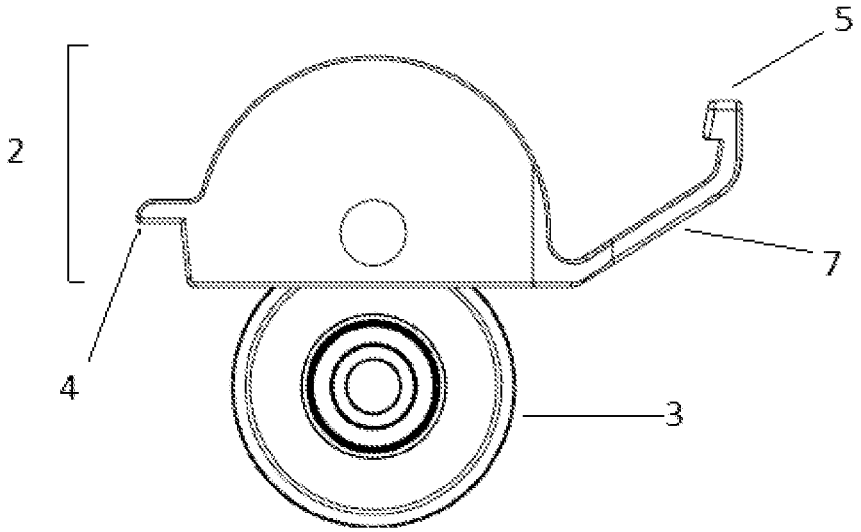
FIG. 2—is an exploded view of the wheel (3) and of frame (2) showing a front locking member (4) on one end and, on the other, a braking plate (7) which geometry matches the inclination of the ramp (10) of the outer sole (1). On the face opposing the braking plate (7), the frame (2) shows a locking member (5) for attachment to the outer sole (1) by engagement on the engagement portion (12) of the ramp (10).
Figure 3:
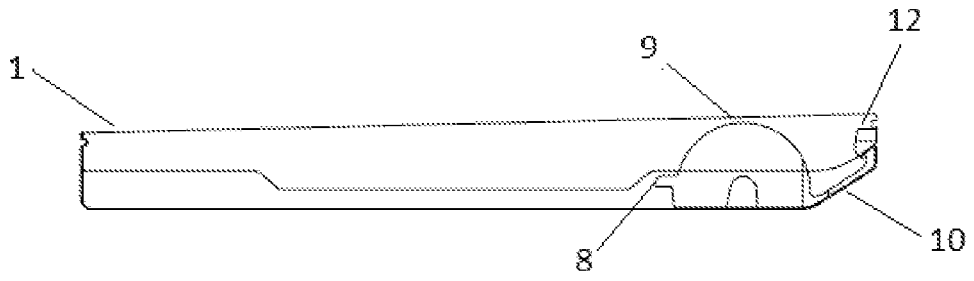
FIG. 3—is a cross section view of the outer sole (1) on which is shown the opening (9) that receives the frames (2)(13), a recess (8) to engage the locking member (4) of frames (2) (13), one ramp (10) in the rear area of the outer sole (1), which includes an engagement portion (12). The opening (9) adjacent to the ramp (10) is also visible.
Figure 4:
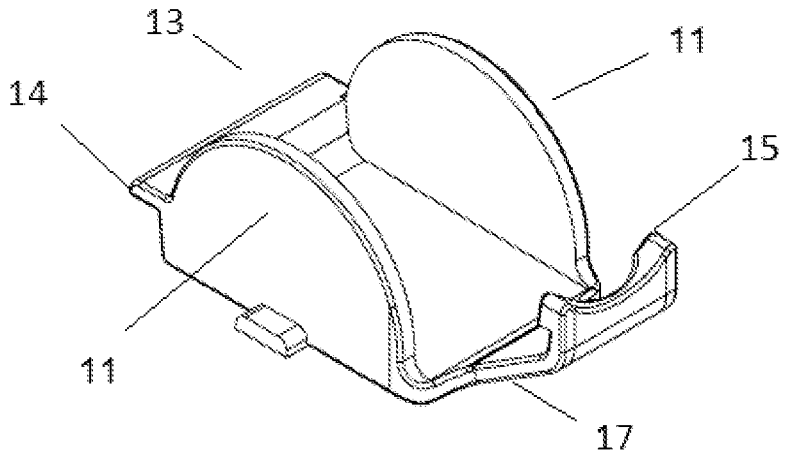
FIG. 4—is a perspective view of the frame (13) which shows a front locking member (14) and a braking plate (17) on the opposite end, accompanying the ramp geometry (10). On the face opposing the braking plate (17) there is a locking member (15) for attachment to the outer sole (1) by engagement to the engagement portion (12) of the ramp (10).
Figure 5:
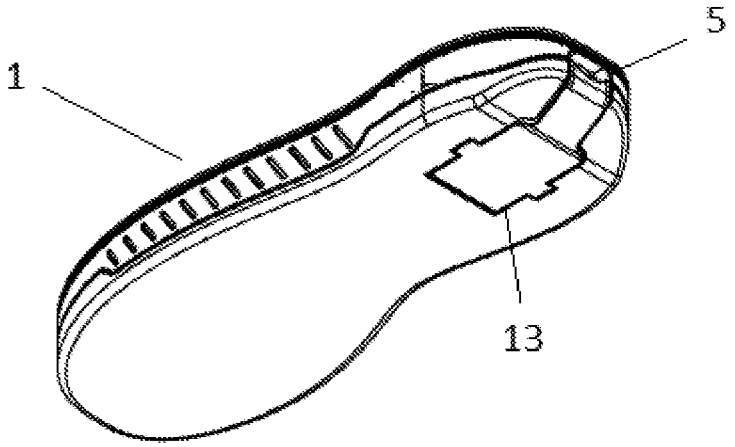
FIG. 5—is a perspective view of the system in a conventional moving mode, composed by the outer sole (1), by the frame (13) and by the locking member (15).
Figure 6:
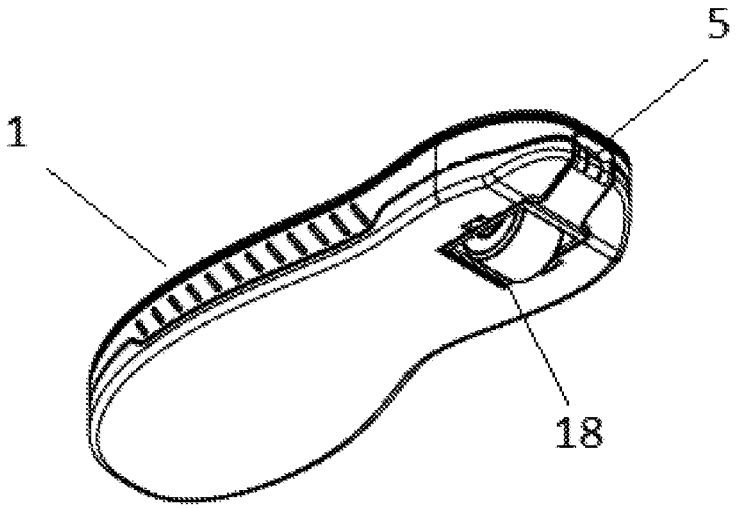
FIG. 6—is a perspective view of the system in a rolling mode, composed by the outer sole (1), by the rolling mechanism (18) with one wheel and by the locking member (5).
Figure 7:
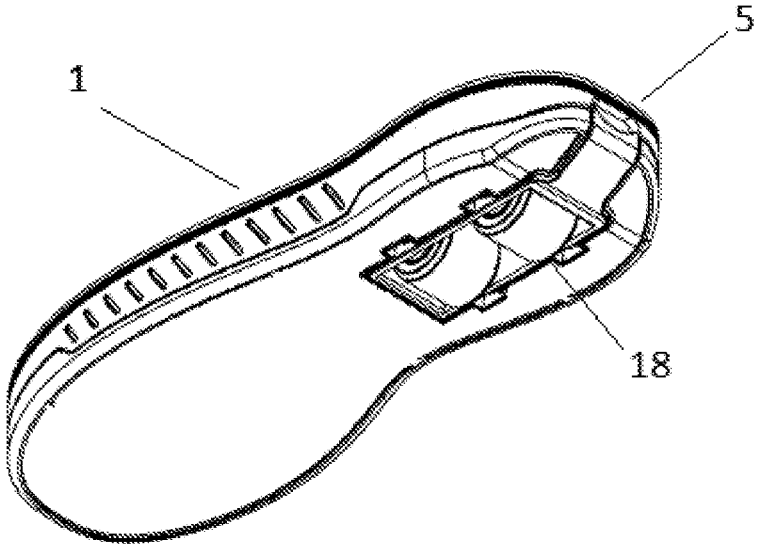
FIG. 7—is a perspective view of the system in a rolling mode, composed by the outer sole (1), by the rolling mechanism (18), with two wheels (3) on line, and by the locking member (5).
Figure 8:
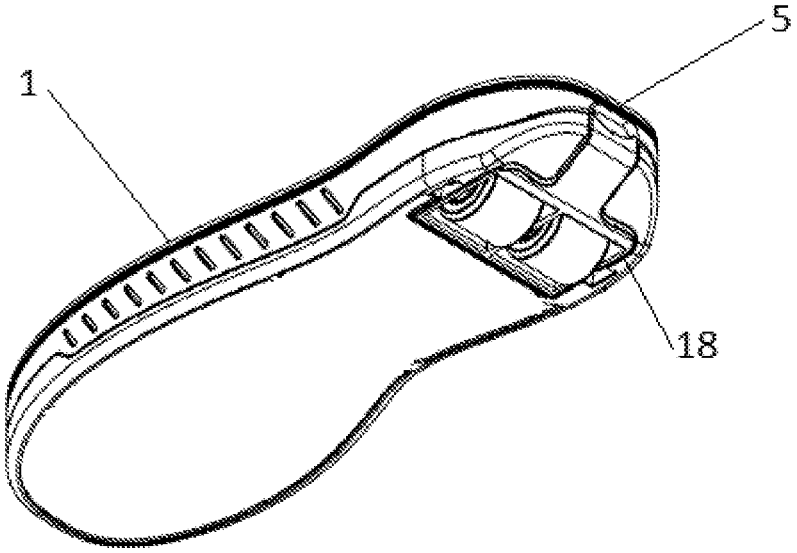
FIG. 8—is a perspective view of the system, in a rolling mode, composed by the outer sole (1), by the rolling mechanism (18), with two parallel wheels (3), and by the locking member (5).

The object of the present invention is one outer sole (1) on which a rolling mechanism (18) is inserted, consisting in a frame (2) and at least one wheel (3), which, in contact with the ground, enables the user to slide, moving as if he were using a skate or, alternatively, inserts one frame (13) that enables a conventional moving mode.

Both frames (2)(13) inserted in the outer sole (1) are removable, i.e., when the user so wishes, he may remove the frame (2) or frame (13), by pressing downwards the locking members (5) or (15) provided in the frames (2)(13).

The possibility of removing the frames (2)(13) by disengagement, just by pressing on the locking members (5) or (15), enables the user to easily alternate the two possible ways of moving himself, by disengaging and engaging the frames (2)(13).

It is now important to detail the composition of the main components of the system, i.e., the outer sole (1), the rolling mechanism (18) and the frame (13) and how they are engaged in and disengaged from the outer sole (1).

The outer sole (1) exhibits a ramp (10) on its rear end, which shows an engagement portion (12), preferably in the form of a cavity. The outer sole (1) does also show an opening (9) to receive a frame (2) or (13) and adjacent to the ramp (10) on one face, and in the opposite face it shows at least one recess (8), which is preferably a slot.

The inclination of the ramp (10) is, preferably, between 29° and 35°.

The rolling mechanism (18) consists in a frame (2) and at least one wheel (3), which is crossed by a metal shaft (6) to attach the wheel (3) to the frame (2).

The frame (2) shows at least a front locking member (4) on one end, intended to be engaged in the outer sole's (1) recess (8) a braking plate (7) on the other end, which accompanies the geometry of the ramp (10), a locking member (5) embossed on the surface opposite the braking plate (7), for attachment to the engagement portion (12) of the outer sole (1).

In an alternative configuration of the invention, the rolling mechanism (18) may be constituted by two wheels (3) on line or by two wheels (3) parallel to each other.

The surface of the braking plate (7) shows anti-wear slots to reduce the speed of the shoe where the outer sole (1), object of the present invention, is integrated while it is moving.

The frame (13), shows one base with flaps (11) and at least one locking member in the front (14) on one end, to be engaged in the recess (8) of the outer sole (1), a braking plate (17) on the other end, accompanying the geometry of the ramp (10), a locking member (15) embossed on the surface opposing the braking plate (17), for attachment to the locking member (12) of the outer sole (1).

It is now important to detail the engagement and disengagement of the frame (2) of the rolling mechanism (18) on the outer sole (1), so that the system may be either converted into a rolling mode, or into a conventional walking mode.

To convert the system into a moving mode, the attachment of the frame (2) to the outer sole (1) is initiated by engaging at least one front locking member (4), in at least one recess (8) of the outer sole (1) and, by pressing upwards, the attachment of the locking member (5) into the engagement portion (12) is performed, thus providing a full integration of the frame (2) in the outer sole (1).

This described form of engaging the frame (2) in the outer sole (1) ensures the stability and good performance of the system, object of the present invention.

When the user wishes to remove the frame (2), he presses the locking member (5), downwards until he disengages it from the engagement portion (12) maintaining the pressure in the same sense and removing the frame (2) from the outer sole (1).

Without the rolling mechanism (18) in place, i.e., in a conventional walking mode, the user may install a frame (13) in a way similar to the engagement of frame (2) of the rolling mechanism (18), since it has the same essential elements for engaging and disengaging.

The attachment of the frame (13) to the sole (1) is initiated by the engagement of at least one front locking member (14), in at least one recess (8) of the outer sole (1) and, by pressing upwards, the attachment of the locking member (15) is performed on the engagement portion (12), thus providing a full integration of the frame (13) in the outer sole (1).

The frame (13) acts like a lid, which, besides protecting the receiving elements of the outer sole (1) when it is in a conventional walking mode, prevents the accumulation of dirt inside the outer sole and promotes stability to the user's locomotion.

In a preferable embodiment, the locking members (5) (15) present an upper curve forming an opening with the basic surface of the shoe, thus facilitating the positioning of the pressure force.

In addition, the frame (13) may be in plastic material and, on the base contacting the ground and on the surface of the braking plate (17) there are slots to prevent the wear due to walking on the ground.

The invention claimed is:

1. Outer sole with a removable sliding system, characterized in that:

a) One outer sole (1) presenting a ramp (10) on its rear end, such ramp with an inclination between 29° and 35° and presenting an engagement portion (12), and one opening (9) adjacent to the ramp (10), on one face and, on the opposite face, showing at least one recess (8);

b) At least one frame (2) (13) to be inserted in the opening (9), such frame (2) (13) presenting at least one front locking member (4) (14) on one end, for engagement in at least one recess (8) of the outer sole (1), at least one braking plate (7) (17) on its other end, accompanying the geometry of the ramp (10), at least one locking member (5) (15) on the surface opposing the braking plate (7) (17), for attachment to the engagement portion (12) of the outer sole (1).

2. Outer sole according to claim 1, characterized in that the frame (2) presents at least one wheel (3), which is crossed by a metal shaft (6) that attaches the wheel (3) to the frame (2).

3. Outer sole according to claim 1, characterized in that the frame (13) has a base with flaps (11).

4. Outer sole according to claim 1, characterized in that the locking member (5)(15) present an upper curve.

5. Outer sole according to claim 1, characterized in that the engagement portion (12) is in the form of a cavity.

6. Outer sole according to claim 1, characterized in that recess (8) is a slot.

7. Outer sole according to claim 1, characterized in that frame (2)(13) is in plastic material.

8. Use of the outer sole described in claim 1 in shoe wear.

* * * * *